United States Patent [19]

Bechtel

[11] 4,203,052

[45] May 13, 1980

[54] SOLID STATE IGNITION SYSTEM

[75] Inventor: Jon H. Bechtel, Holland, Mich.

[73] Assignee: Robertshaw Controls Company, Richmond, Va.

[21] Appl. No.: 888,046

[22] Filed: Mar. 20, 1978

[51] Int. Cl.[2] ..... H05B 37/02; H05B 39/04; H05B 41/36

[52] U.S. Cl. ..... 315/209 CD; 307/252 A; 328/67; 361/256; 315/232; 315/241 R; 315/244

[58] Field of Search ..... 315/209 CD, 209 SC, 315/240, 239, 232, 241, 244, 306; 307/252 A, 252 B; 361/256, 257, 251; 328/67

[56] References Cited

U.S. PATENT DOCUMENTS

| | | | |
|---|---|---|---|
| 3,599,017 | 8/1971 | Oakes | 328/67 |
| 3,673,436 | 6/1972 | Adams, Jr. | 307/252 B |
| 3,781,649 | 12/1973 | Ishida | 315/240 |
| 3,781,690 | 12/1973 | Corson | 328/67 |
| 3,894,273 | 7/1975 | Newport, Jr. et al. | 361/256 |
| 3,949,273 | 4/1976 | Santo | 361/256 |
| 4,001,638 | 1/1977 | Bauer et al. | 315/209 SC |
| 4,055,783 | 10/1977 | Walter et al. | 315/240 |
| 4,086,048 | 4/1978 | Carlson | 361/256 |

*Primary Examiner*—Saxfield Chatmon, Jr.
*Attorney, Agent, or Firm*—Malcolm R. McKinnon

[57] ABSTRACT

A solid state ignition system for generating high frequency and high energy electrical pulses, the system providing improved performance under varying line voltage conditions, improved voltage regulation, and reduced power dissipation, and being effective to produce an improved ionization arc between electrodes effective to initiate fuel oil combustion.

38 Claims, 1 Drawing Figure

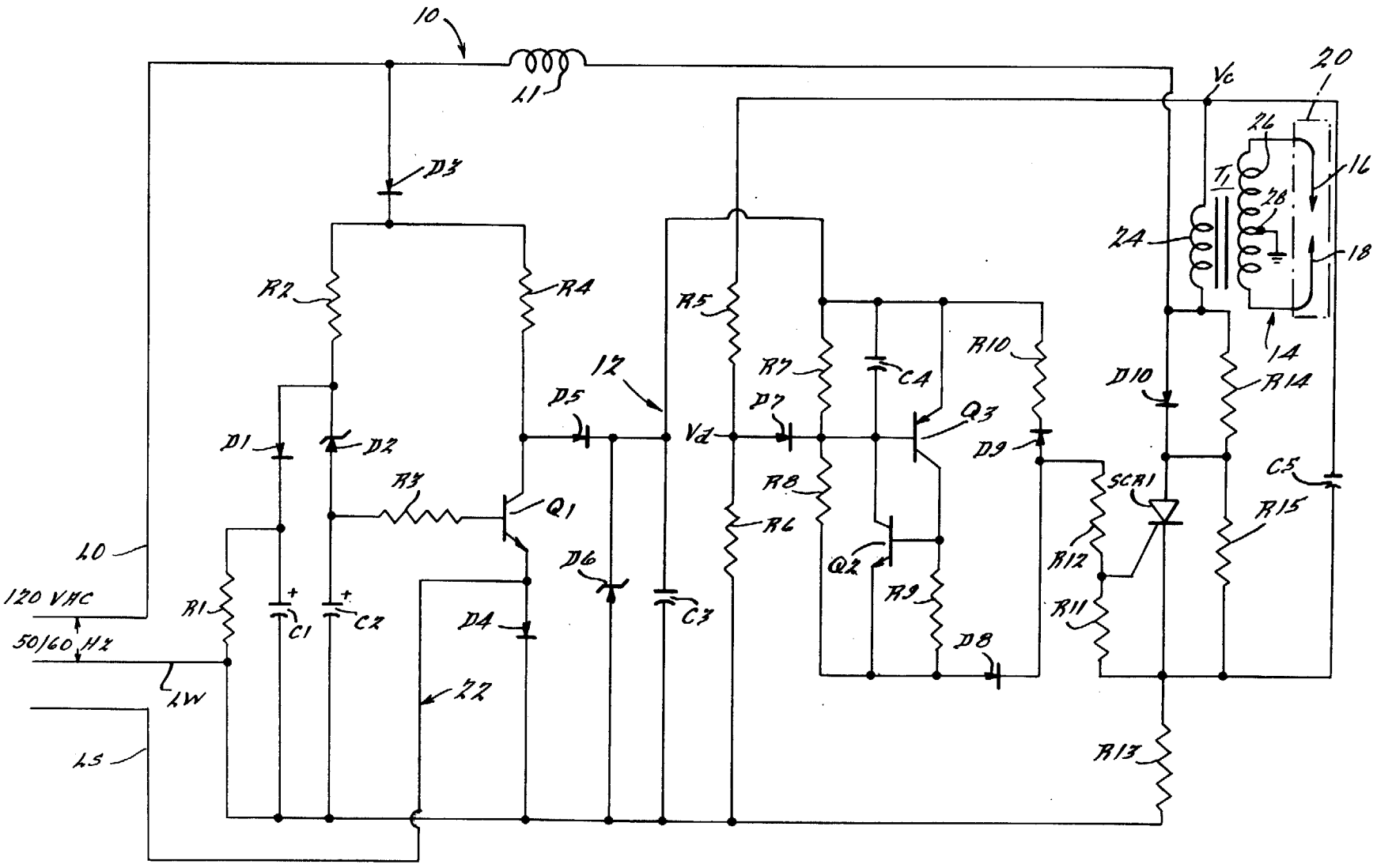
20
16
18
26
28
14
T1
24
Vc
R14
C5
R15
D10
SCR1
R12
R11
R13
R10
Q3
D9
D8
C4
R9
Q2
R7
D7
R8
R6
R5
Vd
C3
12
D5
D6
R4
Q1
D4
R7
11
10
D3
R3
D2
C2
R2
C1
D1
R1
1W
10
120 VAC
50/60 Hz
15

SOLID STATE IGNITION SYSTEM

BRIEF SUMMARY OF THE INVENTION

This invention relates to ignition systems and, more particularly, to an improved solid state ignition system for generating high frequency and high energy electrical pulses effective to produce an improved ionization arc between electrodes effective to initiate fuel oil combustion, it being understood that the present invention is also applicable to other uses requiring high frequency and high energy electrical pulses.

Heretofore, solid state ignition systems have been utilized to produce ionization arcs between electrodes for the purpose of initiating fuel oil combustion, the ignition system disclosed in U.S. Pat. No. 4,001,638, issued Jan. 4, 1977, and assigned to the assignee of the present invention, being representative of such a prior solid state ignition system. An object of the present invention is to overcome disadvantages in prior ignition systems of the indicated character and to provide an improved solid state ignition system incorporating improved means for generating high frequency and high energy electrical pulses effective to produce an improved ionization arc between electrodes whereby fuel oil combustion may be initiated in furnaces.

Another object of the invention is to provide an improved solid state ignition system providing improved performance under varying line voltage conditions.

Another object of the present invention is to provide an improved solid state ignition system incorporating improved means for effecting voltage regulation and improved means for reducing power dissipation of various components of the system.

Another object of the present invention is to provide an improved solid state ignition system which is readily adaptable to meet the ignition requirements of a wide variety of oil burners and primary controls therefor.

Another object of the present invention is to provide an improved solid state ignition system which incorporates improved means for producing an intermittent high frequency and high energy ionization arc effective to initiate combustion of fuel oil in a minimum of time thereby increasing user economy by reducing power consumption and increasing transformer and electrode life, and also reducing radio frequency interference.

Still another object of the present invention is to provide an improved solid state ignition system which may be economically manufactured and assembled and which operates efficiently and reliably under adverse operating conditions.

The above as well as other objects and advantages of the present invention will become apparent from the following description, the appended claims and the accompanying drawing.

BRIEF DESCRIPTION OF THE DRAWING

The single FIGURE is a schematic diagram of an ignition system embodying the present invention.

DETAILED DESCRIPTION

Referring to the single drawing, a schematic diagram of an ignition system, generally designated 10, embodying the present invention is illustrated therein. As shown in the drawing, the system 10 is adapted to be connected to a conventional source of line voltage alternating current, such as conventional nominal 120 volt alternating current. The system 10 includes a high frequency and high energy pulse generating circuit, generally designated 12, and a combustion initiator circuit, generally designated 14, the components incorporated in such circuitry all being electrically connected by suitable conductors as illustrated in the drawings and as will be described hereinafter in greater detail.

In general, overall circuit operation is somewhat similar to that of the ignition system disclosed in the aforementioned U.S. Pat. No. 4,001,638. However, the present invention provides significant improvements in the form of improved performance under varying line voltage conditions, improved voltage regulation, and reduced power dissipation while producing improved arc current under widely varying line voltage conditions.

The present invention system 10 illustrated in the figure of the drawing hereof, operates generally in the following manner: Line voltage is supplied to the system 10 from the main line source of AC current to the high frequency and high energy pulse generating circuit 12 and the associated combustion initiator circuit 14 for combustion initiation. Applied line voltage at a nominal supply of 120 VAC causes the system 10 to initiate a high frequency ionic breakdown across electrodes 16 and 18 located within a combustion chamber 20, an oil pump/blower motor or other means (not shown) being provided to cause oil to be sprayed into the combustion chamber 20. The oil particles pass through the ionic discharge area of the electrodes 16 and 18 incorporated in the combustion initiator circuit 14 and the oil particles are ignited. A synchronizing circuit 22 is provided which controls initiation of sparking across the electrodes 16 and 18 at the proper time in the AC cycle, and means is also provided to insure that the system will always spark for a period of two to four seconds when power is initially applied.

Referring in greater detail to the components of the system 10, the high frequency, high energy pulse generating circuit 12 includes an inductor L1, the primary winding 24 of a step up transformer T1, capacitors C1 through C5, diodes D1 through D10, transistors Q1, Q2 and Q3, resistors R1 through R15, and a silicon controlled rectifier SCR1, the above components all being electrically connected by suitable conductors as illustrated in the drawing. The combustion initiator circuit 14 includes the secondary winding 26 of the step up transformer T1 and the electrodes 16 and 18 connected to the opposite ends, respectively, of the secondary winding 26 while the center tap 28 of the secondary winding 26 is grounded as illustrated in the drawing. The synchronizing circuit 22 includes the lead LS which leads to a conventional primary control or other suitable means (not shown) adapted to apply an AC signal in phase with the line voltage to the node between the emitter of the transistor Q1 and the diode D4 so as to cause the system 10 to produce the ionic spark discharge across the electrodes 16 and 18 at the proper time in the AC cycle as will be described hereinafter in greater detail.

The high voltage transformer T1 receives energy from the discharge of the capacitor C5, the capacitor C5 being charged from positive line voltage on the lead L0 through the series connected inductor L1 and resistor R13. The inductor L1 limits the charging current on the capacitor C5, and through resonant action of the inductor L1 and the capacitor C5, the voltage on the capacitor C5 is raised to a substantially greater level than the source voltage, as for example, above 545 volts even though the peak supply voltage may be less than 150 volts. A delay in triggering the silicon controlled recitifer SCR1 allows the capacitor C5 to charge to its peak voltage and then to begin to discharge back through the inductor L1 and resistor R13. Since the resistance of the resistor R13 is relatively low, most of the energy discharged by the capacitor C5 is returned to the line voltage supply. The resistor R13 further limits the charging current and provides circuit protection in the event that the silicon controlled rectifier SCR1 fails to turn off. When this occurs, the silicon controlled rectifier SCR1 conducts through the remainder of the positive line cycle and the current is limited only by the resistor R13.

The silicon controlled rectifier SCR1 is triggered to discharge the capacitor C5 into the primary winding 24 of the transformer T1 after any charge on the capacitor C5 in excess of the desired level has discharged back through the inductor L1 into the charging source. Energy stored in the large leakage inductance of the transformer T1 carries the capacitor C5 negative, thereby providing the silicon controlled rectifier SCR1 with sufficient time to turn off. The fast recovery diode D10 limits reverse current through the silicon controlled rectifier SCR1 until it turns off. The resistor R14 allows a limited reverse current in the silicon controlled rectifier SCR1 to speed its turn off. The resistors R14 and R15 form a voltage divider placing a portion of the negative voltage from the series combination of the primary winding 24 of the transformer T1 and the capacitor C5 on the diode D10. When no spark gap is provided for the transformer T1, a large ringing voltage occurs on the secondary winding 26 of the transformer T1. This induces a voltage in the primary winding 24 of the transformer T1 which when added to the voltage on the capacitor C5 exceeds the negative voltage rating of the silicon controlled rectifier SCR1. The portion of the negative voltage absorbed by the diode D10 reduces the negative voltage on the silicon controlled rectifier SCR1 to a value which is close to its maximum rating. Since the primary winding 24 of the transformer T1 is placed in the charging path between the inductor L1 and the capacitor C5, the charging circuit induces additional current in the arc thereby increasing its energy.

Firing of the silicon controlled rectifier SCR1 is controlled by a trigger circuit, and firing of the silicon controlled rectifier SCR1 occurs only after both of the following conditions are met: (1). The charging current on the capacitor C5 has fallen to nearly zero or is negative, that is the capacitor C5 is nearly charged or is discharging. (2). The voltage on the capacitor C5 is below a nominal 545 volt threshold value. Condition (1) is controlled by the voltage on the resistor R13, and condition (2) is controlled by the voltage Vd from the divider formed by the resistors R5 and R6. Operation of the trigger circuit is as follows: The transistors Q2 and Q3 operate much like a programmable unijunction transistor. The transistor pair comprising the transistors Q2 and Q3 is triggered when the base to emitter voltage of the transistor Q3 reaches negative 0.6 volts. The transistor Q3 conducts thereby turning on the transistor Q2 which supplies additional drive to the transistor Q3, latching the transistors Q2 and Q3 into conduction, and discharging the capacitor C3 through the diode D8, through the current limiting resistor R12 and into the gate of the silicon controlled rectifier SCR1. The transistors Q2 and Q3 latch into conduction until the current through them goes to almost zero.

The resistor R9 prevents a small leakage current in the transistor Q3 from turning on the transistor Q2. The capacitor C4 reduces unwanted triggering of the transistor pair Q2 and Q3 due to noise. The resistor R7 prevents a small leakage current in the transistor Q2 from turning on the transistor Q3 and the resistors R7 and R8 form a voltage divider which triggers the transistors Q2 and Q3 when the diode D7 is not conducting and when the voltage drop across the divider is approximately 6 volts. The voltage drop across the divider formed by the resistors R7 and R8 must increase to approximately 6 volts before the transistor Q3 conducts to trigger the silicon controlled rectifier SCR1. The capacitor C3 must be charged and the voltage across the resistor R13 must be less than approximately 2.5 volts before the transistor Q3 can be turned on. This voltage is adequate to trigger the silicon controlled recitifer SCR1. As previously mentioned, firing of the circuit discharges the capacitor C3 through the diode D8 and the current limiting resistor R12 and into the gate of the silicon controlled rectifier SCR1.

The Zener diode D6 limits the voltage on the capacitor C3 to approximately 10 volts. The resistors R5 and R6 divide the voltage on the capacitor C5 to a value Vd which equals approximately 10 volts when the voltage Vc is approximately 545 volts. When Vc exceeds 545 volts, Vd exceeds 10 volts and the diode D7 conducts holding the base of the transistor Q3 too high relative to the 10 volt value at its emitter for it to turn on and creating an additional delay in the turn on of the transistor Q3 until the capacitor C5 has discharged to approximately 545 volts. The capacitor C5 begins to discharge back into the line through the inductor L1. When Vc falls to approximately 545 volts, Vd is ten volts, and conduction in the diode D7 falls to the point that the transistors Q2 and Q3 are triggered thereby firing the silicon controlled rectifier SCR1. The capacitor C5 is discharged and carried negative by the inductance of the primary winding 24 of the transformer T1. This inductance is small relative to the inductor L1. Thus, discharge time is short relative to the energy storage capacitor charging time. Charging currents through the inductor L1, primary winding 24 of the transformer T1, the capacitor C5 and the resistor R13 increases thereby increasing the voltage across the resistor R13. The positive voltage across the resistor R13 causes current to flow through the resistors R11, R12, R10, the diode D9 and to charge the capacitor C3. The current through the resistor R11 places a small negative voltage on the gate of the silicon controlled rectifier SCR1 to speed turn off. A charge is also placed on the capacitor C3. Thus the capacitor C3 needs to be charged by the synchronizing circuit through the diode D5 only for the first firing during each positive half cycle of the 60 Hz line voltage.

The capacitor C3 is charged through the diode D3, resistor R4 and diode D5 to initiate arcing during the positive half cycle of the line L0. The system automatically sparks for a period of two to four seconds each time the lead L0 is energized following several minutes of off time. The two to four second timing is controlled by the capacitor C1, the resistor R2 and the diode D2. When power is initially applied via the lead L0, current flows from the resistor R2 through the diode D1 and capacitor C1 preventing flow of current through the diode D2. After approximately 2.5 seconds, the voltage on the capacitor C1 increases to the Zener voltage of the diode D2. The Zener diode D2 conducts charging the capacitor C2 and supplying current through the resistor R3 to turn on the transistor Q1 which prevents charge of the capacitor C3, thus to hold the system in the off state.

The voltage drop across the resistor R3 is determined by the supply voltage and by the ratio of the resistor R2 to the resistor R3. This voltage drop is nominally 0.2 volts. The resistor R2 establishes a steady current into the base of the transistor Q1 and establishes the AC voltage level required on the synchronizing lead LS to turn the system on. The system is turned on by an AC signal on the line LS, such signal being in phase with the line voltage. Such a signal reduces the base emitter voltage of the transistor Q1 during the positive half cycle thereby turning the transistor Q1 off at the proper time in the AC cycle to allow the capacitor C3 to charge and the system to spark. The capacitor C1 prevents turn on of the transistor Q1 when power is initially applied to the system. This assures that the system will always spark for a period of two to four seconds when power is initially applied.

The resistor R1 discharges the capacitor C1 to reinitiate the timing interval and the diode D4 prevents continuous turn on of the unit when the synchronizing lead LS is not connected. The transistor Q1 may turn on during a portion of the cycle while the circuit is oscillating. The diode D5 isolates the capacitor C3 from the effect of such a turn on. The diode D4 and the diode D5 also prevent damage to the circuit in the event that the lead LW is disconnected when the leads L0 and LS are connected. The only other paths to the transistor Q1 are through the resistors R4 and R5. These resistors are large enough to prevent damage to circuit components.

The inductor L1 saturates at high current levels. However, the current level is low and the inductor L1 is not saturated at the beginning of the capacitor charging cycle. The larger inductance of the non-saturated inductor L1 decreases the rate at which the capacitor charges initially, thus extending the interval of time that the anode of the silicon controlled rectifier SCR1 is negative. This is the interval allowed for the silicon controlled rectifier SCR1 to turn off. The larger inductance of the nonsaturated inductor L1 is especially effective during the first turn off of the silicon controlled rectifier SCR1 in each new positive half cycle of the AC line. In this case, the energy storage capacitor C5 is initially charged to the line voltage and not approximately three times the line voltage as is usual when the oscillation grows. The result is that the capacitor C5 does not swing as far negative. It thus takes less time to recharge it to the point where the silicon controlled rectifier SCR1 anode may go positive. Positive SCR anode voltage turns on the silicon controlled rectifier SCR1 which has not regained its blocking capability. In the circuit, oscillation would stop and the silicon controlled rectifier would draw high current for the remainder of the positive line cycle. The capacitor charging current level during this weak first cycle is very low. Thus, the high inductance of the non-saturated inductor L1 extends the capacitor charging time to provide adequate turn off time for the silicon controlled rectifier SCR1. Unwanted turn on of the silicon controlled rectifier SCR1 as described above does not occur.

It has been found that it is not desirable to saturate the entire core of the inductor L1 because the inductance then drops too low. Also, loss in a medium grade of transformer iron is excessive when it is taken into and out of saturation at a 5 kHz rate. It is preferred to utilize a standard iron "E" lamination stack with the "I" lamination stack being replaced with two lengths of ferrite. The ferrite saturates before the iron and with lower loss, and saturation of the ferrite produces what amounts to a large air gap in the magnetic path of the inductor L1. This prevents saturation of the iron, the magnetic path provided by the ferrite at low flex levels increasing the inductance at low current levels.

The above described operation repeats itself many times during each positive half cycle of the applied line voltage. This results in what appears to be a steady ionization arc across the electrodes 16 and 18. It is well understood by those skilled in the art that oil requires much energy to ignite, and that, additionally, the ion path directly between the electrodes 16 and 18 should not be in the oil spray itself or malfunction could result. Consequently, these rapid multiple discharges are preferably "blown" into the oil spray by a blower section incorporated in the means spraying oil into the combustion chamber 20.

Typical values for the components of the system 10 described hereinabove are as follows:

Cl: 10 MFD, 20 V, 20%, TANT
C2: 6.8 MFD, 20 V, 20%, TANT
C3: 0.047, 100 V, 20%, MYLAR
C4: 3300 pf, 20%, CERAMIC
C5: 0.56 MFD, 600 V, 10%, MF
D1: IN4148, 75 PIV
D2: IN5246A, 16 V, 10%
D3: IN4004, 400 PIV
D4: IN4004, 400 PIV
D5: IN4004, 400 PIV
D6: IN5240B, 10 V, 5%
D7: IN4148, 75 PIV
D8: IN4004, 400 PIV
D9: IN4148, 75 PIV
D10: RCA-65047
Q1: 2N5825, NPN
Q2: 2N3904, NPN
Q3: 2N5375, PNP
R1: 8.2 Mpg, ½ Watt
R2: 820 K, ½ Watt
R3: 4.7 K, ½ Watt
R4: 220 K, ½ Watt
R5: 300 K, ½ Watt, 2%, CF
R6: 5.6 K, ½ Watt, 2%, CF
R7: 10 K, ½ Watt
R8: 82 K, ½ Watt
R9: 10 K, ½ Watt
R10: 2.7 K, ½ Watt
R11: 150 ohms, ½ Watt
R12: 47 ohms, ½ Watt
R13: 7.5 ohms, PW22, 10%
R14: 1500 ohms, 1 Watt, CC
R15: 10 K, 2 Watt, CC
SCR1: RCA-67045, 600 V
L1: 25 Mh
T1: High Voltage Transformer It will be understood, however, that these values may be varied depending upon the particular application of the principles of the present invention.

While a preferred embodiment of the invention has been illustrated and described, it will be understood that various changes and modifications may be made without departing from the spirit of the invention.

What is claimed is:

1. A pulse source for generating high frequency and high energy electrical pulses comprising, in combination, a pulse generating circuit adapted to be connected to a source of AC current, said pulse generating circuit including a capacitor, a load connected to said capacitor, means including an inductor effective to charge said capacitor to a voltage level substantially greater than the voltage of the AC source, trigger means actuatable to discharge said capacitor through said load, and capacitor charge voltage monitoring means effective to delay discharge of said capacitor through said load until any capacitance charge in excess of a predetermined level has discharged back through said inductor into the source.

2. The combination as set forth in claim 1 including a turn off circuit.

3. The combination as set forth in claim 1, said trigger means including a silicon controlled rectifier having an anode, a cathode and a gate, said anode and said cathode being connected in series with said load, said monitoring means being connected to said gate of said silicon controlled rectifier.

4. The combination as set forth in claim 1 including resistance means connected with said capacitor and said inductor and limiting the charging current applied to said capacitor.

5. The combination as set forth in claim 1, said monitoring means including voltage divider means.

6. The combination as set forth in claim 1, said load being in the form of a transformer having a primary winding and a secondary winding, said capacitor being connected to said primary winding of said transformer.

7. The combination as set forth in claim 1 including a synchronizing circuit adapted to apply an AC signal to said monitoring means in phase with the AC voltage of the source.

8. The combination as set forth in claim 3 including diode means limiting reverse current through said silicon controlled rectifier.

9. The combination as set forth in claim 2, said monitoring means including a PNP transistor and an NPN transistor, said turn off circuit including a second NPN transistor effective to hold said first NPN transistor and said PNP transistor in the off state.

10. The combination as set forth in claim 1, said load being electrically connected between said inductor and said capacitor.

11. In a pulse source for generating high frequency and high energy electrical pulses, the combination including a pulse generating circuit adapted to be connected to a source of AC current, said pulse generating circuit including a capacitor, a load connected to said capacitor, means including an inductor effective to charge said capacitor to a voltage level substantially greater than the voltage of the AC source, trigger means including a silicon controlled rectifier actuatable to discharge said capacitor through said load, and capacitor charge voltage monitoring means effective to delay discharge of said capacitor through said load until any capacitance charge in excess of a predetermined level has discharged back through said inductor into the source.

12. The combination as set forth in claim 11, said silicon controlled rectifier having an anode, a cathode and a gate, said anode and said cathode being connected in series with said load, said monitoring means being connected to said gate of said silicon controlled rectifier.

13. The combination as set forth in claim 12 including a turn off circuit.

14. The combination as set forth in claim 13 including resistance means connected with said capacitor and said inductor and limiting the charging current applied to said capacitor.

15. The combination as set forth in claim 14, said monitoring means including voltage divider means.

16. The combination as set forth in claim 15 including a synchronizing circuit adapted to apply an AC signal to said monitoring means in phase with the AC voltage of the source.

17. The combination as set forth in claim 16 including diode means limiting reverse current through said silicon controlled rectifier.

18. The combination as set forth in claim 17, said monitoring means including a PNP transistor and an NPN transistor, said turn off circuit including a second NPN transistor effective to hold said first NPN transistor and said PNP transistor in the off state.

19. The combination as set forth in claim 18, said load being in the form of a transformer having a primary winding and a secondary winding, said capacitor being connected to said primary winding of said transformer, and a pair of spaced electrodes electrically connected to said secondary winding of said transformer.

20. The combination as set forth in claim 19, said primary winding of said transformer being electrically connected between said inductor and said capacitor.

21. In an ignition system, the combination comprising high frequency and high energy pulse generating means, combustion initiation means operatively connected to said pulse generating means, said pulse generating means including a capacitor, a transformer having a primary winding and a secondary winding, said primary winding being connected to said capacitor, means including an inductor effective to charge said capacitor through said primary winding to a voltage level substantially greater than the voltage of the AC source, trigger means actuatable to discharge said capacitor through said primary winding of said transformer, and capacitor charge voltage monitoring means effective to delay discharge of said capacitor through said primary winding until any capacitance charge in excess of a predetermined level has discharged back through said inductor into the source.

22. The combination as set forth in claim 21 including a turn off circuit.

23. The combination as set forth in claim 21, said trigger means including a silicon controlled rectifier having an anode, a cathode and a gate, said anode and said cathode being connected in series with said primary winding of said transformer, said monitoring means being connected to said gate of said silicon controlled rectifier.

24. The combination as set forth in claim 21 including resistance means connected with said capacitor and said inductor and limiting the charging current applied to said capacitor.

25. The combination as set forth in claim 21, said monitoring means including voltage divider means.

26. The combination as set forth in claim 21 including a synchronizing circuit adapted to apply an AC signal to said monitoring means in phase with the AC voltage of the source.

27. The combination as set forth in claim 23 including diode means limiting reverse current through said silicon controlled rectifier.

28. The combination as set forth in claim 21, said monitoring means including a PNP transistor and an NPN transistor, and means effective to hold said transistors in the off state.

29. The combination as set forth in claim 21 including a pair of spaced electrodes electrically connected to said secondary winding of said transformer.

30. In an ignition system for oil burners, the combination comprising high frequency and high energy pulse generating means, combustion initiation means operatively connected to said pulse generating means, said pulse generating means including a capacitor, a transformer having a primary winding and a secondary winding, said primary winding being connected to said capacitor, said combustion initiation means including a pair of spaced electrodes electrically connected to said secondary winding, means including an inductor effective to charge said capacitor through said primary winding to a voltage level substantially greater than the voltage of the AC source, trigger means including a silicon controlled rectifier actuatable to discharge said capacitor through said primary winding of said transformer, and capacitor charge voltage monitoring means effective to delay discharge of said capacitor through said primary winding until any capacitance charge in excess of a predetermined level has discharged back through said inductor into the source.

31. The combination as set forth in claim 30, said silicon controlled rectifier having an anode, a cathode and a gate, said anode and said cathode being connected in series with said primary winding of said transformer, said monitoring means being connected to said gate of said silicon controlled rectifier.

32. The combination as set forth in claim 31 including resistance means connected with said capacitor and said inductor and limiting the charging current applied to said capacitor.

33. The combination as set forth in claim 32, said monitoring means including voltage divider means.

34. The combination as set forth in claim 33 including a synchronizing circuit adapted to apply an AC signal to said monitoring means in phase with the AC voltage of the source.

35. The combination as set forth in claim 34 including diode means limiting reverse current through said silicon controlled rectifier.

36. The combination as set forth in claim 35, said monitoring means including a PNP transistor and an NPN transistor, and means effective to hold said transistors in the off state.

37. The combination as set forth in claim 36, said monitoring means including time delay means.

38. The combination as set forth in claim 36, said means for holding said transistors in the off state including a second NPN transistor.

* * * * *